US008870181B2

(12) United States Patent
Morikawa et al.

(10) Patent No.: US 8,870,181 B2
(45) Date of Patent: Oct. 28, 2014

(54) PAPER CONVEYING APPARATUS WITH SIDE GUIDE AND SOUND DETECTOR

(71) Applicant: PFU Limited, Kahoku (JP)

(72) Inventors: Shuichi Morikawa, Kahoku (JP); Masanobu Hongo, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/960,648

(22) Filed: Aug. 6, 2013

(65) Prior Publication Data

US 2014/0054844 A1 Feb. 27, 2014

(30) Foreign Application Priority Data

Aug. 24, 2012 (JP) ..... 2012-185471

(51) Int. Cl.
*B65H 1/00* (2006.01)
*B65H 5/00* (2006.01)

(52) U.S. Cl.
CPC ... *B65H 5/00* (2013.01); *B65H 1/00* (2013.01)
USPC ..... 271/171; 271/169

(58) Field of Classification Search
CPC ..... B65H 2515/82; B65H 7/10; B65H 9/101; B65H 2511/528; B65H 2601/255; B65H 2601/2525; B65H 2601/2531
USPC ..... 271/169, 171
See application file for complete search history.

(56) References Cited

U.S. PATENT DOCUMENTS

| | | | |
|---|---|---|---|
| 3,603,680 | A | 9/1971 | Barton |
| 7,502,570 | B2 | 3/2009 | Nishimura et al. |
| 7,587,299 | B2 | 9/2009 | Miyasaka et al. |
| 8,567,777 | B2 | 10/2013 | Syracuse et al. |
| 8,585,050 | B2 | 11/2013 | Syracuse et al. |
| 2005/0189707 | A1 | 9/2005 | Sano et al. |
| 2007/0018376 | A1 | 1/2007 | Sano et al. |
| 2007/0177887 | A1 | 8/2007 | Haas et al. |

(Continued)

FOREIGN PATENT DOCUMENTS

| | | |
|---|---|---|
| JP | 57-169767 | 10/1982 |
| JP | 03-175460 | 7/1991 |

(Continued)

OTHER PUBLICATIONS

Office action mailed Jul. 16, 2013 in JP 2012-185219, including English translation, 5pp.

(Continued)

*Primary Examiner* — Gerald McClain
(74) *Attorney, Agent, or Firm* — Christie, Parker & Hale, LLP

(57) ABSTRACT

There are provided a paper conveying apparatus which can effectively detect a sound which is generated when a jam occurs for various types of jams. The paper conveying apparatus includes a side guide, arranged to be movable in a direction which is perpendicular to a conveyance direction of a paper placed on a paper tray, for restricting a width direction of the paper, a sound signal generator, provided at the side guide so that a sound detector moves in accordance with movement of the side guide, for generating a sound signal corresponding to a sound generated by the paper during conveyance of the paper, and a sound jam detector for determining whether a jam has occurred based on the sound signal.

3 Claims, 19 Drawing Sheets

(56) References Cited

U.S. PATENT DOCUMENTS

| | | | | |
|---|---|---|---|---|
| 2009/0003857 | A1 | 1/2009 | Kuramochi et al. | |
| 2009/0041485 | A1 | 2/2009 | Shoji et al. | |
| 2012/0019841 | A1 | 1/2012 | Schaertel et al. | |
| 2012/0235921 | A1 | 9/2012 | Laubach | |
| 2012/0235929 | A1 | 9/2012 | Hongo et al. | |
| 2013/0093136 | A1* | 4/2013 | Sakharshete et al. | 271/265.01 |
| 2013/0140757 | A1 | 6/2013 | Phinney et al. | |
| 2013/0300056 | A1 | 11/2013 | Kai | |
| 2014/0054252 | A1* | 2/2014 | Woodley et al. | 211/183 |
| 2014/0054840 | A1* | 2/2014 | Umi et al. | 271/10.01 |
| 2014/0054841 | A1 | 2/2014 | Morikawa et al. | |
| 2014/0054849 | A1 | 2/2014 | Morikawa et al. | |
| 2014/0054850 | A1* | 2/2014 | Umi et al. | 271/264 |
| 2014/0054851 | A1 | 2/2014 | Morikawa et al. | |
| 2014/0054852 | A1 | 2/2014 | Hongo et al. | |
| 2014/0062008 | A1 | 3/2014 | Hongo et al. | |

FOREIGN PATENT DOCUMENTS

| | | |
|---|---|---|
| JP | 5-97283 | 4/1993 |
| JP | 5-97284 | 4/1993 |
| JP | 8-2746 | 1/1996 |
| JP | 11-116098 | 4/1999 |
| JP | 2001-302021 | 10/2001 |
| JP | 2005-082350 | 3/2005 |
| JP | 2005-249819 | 9/2005 |
| JP | 2006-201316 | 8/2006 |
| JP | 2006-290515 | 10/2006 |
| JP | 2006290515 A * | 10/2006 |
| JP | 2006-322947 | 11/2006 |
| JP | 2007-86173 | 4/2007 |
| JP | 2008-207885 | 9/2008 |
| JP | 2009-249046 | 10/2009 |
| JP | 2010-030772 | 2/2010 |
| JP | 2010-54558 | 3/2010 |
| JP | 2011-180481 | 9/2011 |
| JP | 2011-254248 | 12/2011 |
| JP | 2012-6738 | 1/2012 |

OTHER PUBLICATIONS

Office action mailed Jul. 9, 2013 in JP 2012-202627, including English translation, 5pp.

Office action mailed Jul. 16, 2013 in JP 2012-195225, including English translation, 6pp.

Office action mailed Jul. 16, 2013 in JP 2012-195325, including English translation, 6pp.

Office action mailed Jul. 16, 2013 in JP 2012-195225, including English translation, 7pp.

Office action mailed Jul. 9, 2013 in JP 2012-203504, including English translation 5pp.

* cited by examiner

PAPER CONVEYING APPARATUS WITH SIDE GUIDE AND SOUND DETECTOR

CROSS-REFERENCE TO RELATED APPLICATIONS

This application is based upon and claims the benefit of priority of prior Japanese Patent Application No. 2012-185471, filed on Aug. 24, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection apparatus of a copier which converts the sound which is generated on the conveyance path to an electrical signal and determines that a jam has occurred when the time when the signal is over a reference level exceeds a reference value has been disclosed (see Japanese Laid-open Patent Publication No. 57-169767).

SUMMARY

However, the position at which sound is generated when a jam has occurred differs according to the situation, so it is desirable to be able to detect sound at the optimum detection position for the type of the jam.

Accordingly, it is an object of the present invention to provide a paper conveying apparatus which can effectively detect a sound which is generated when a jam occurs for various types of jams.

According to an aspect of the apparatus, there is provided a paper conveying apparatus. The paper conveying apparatus includes a side guide, arranged to be movable in a direction which is perpendicular to a conveyance direction of a paper placed on a paper tray, for restricting a width direction of the paper, a sound signal generator, provided at the side guide so that a sound detector moves in accordance with movement of the side guide, for generating a sound signal corresponding to a sound generated by the paper during conveyance of the paper, and a sound jam detector for determining whether a jam has occurred based on the sound signal.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus according to an embodiment, will be described with reference to the drawings. However, note that the technical scope of the invention is not limited to these embodiments and extends to the inventions described in the claims and their equivalents.

Figure 1:
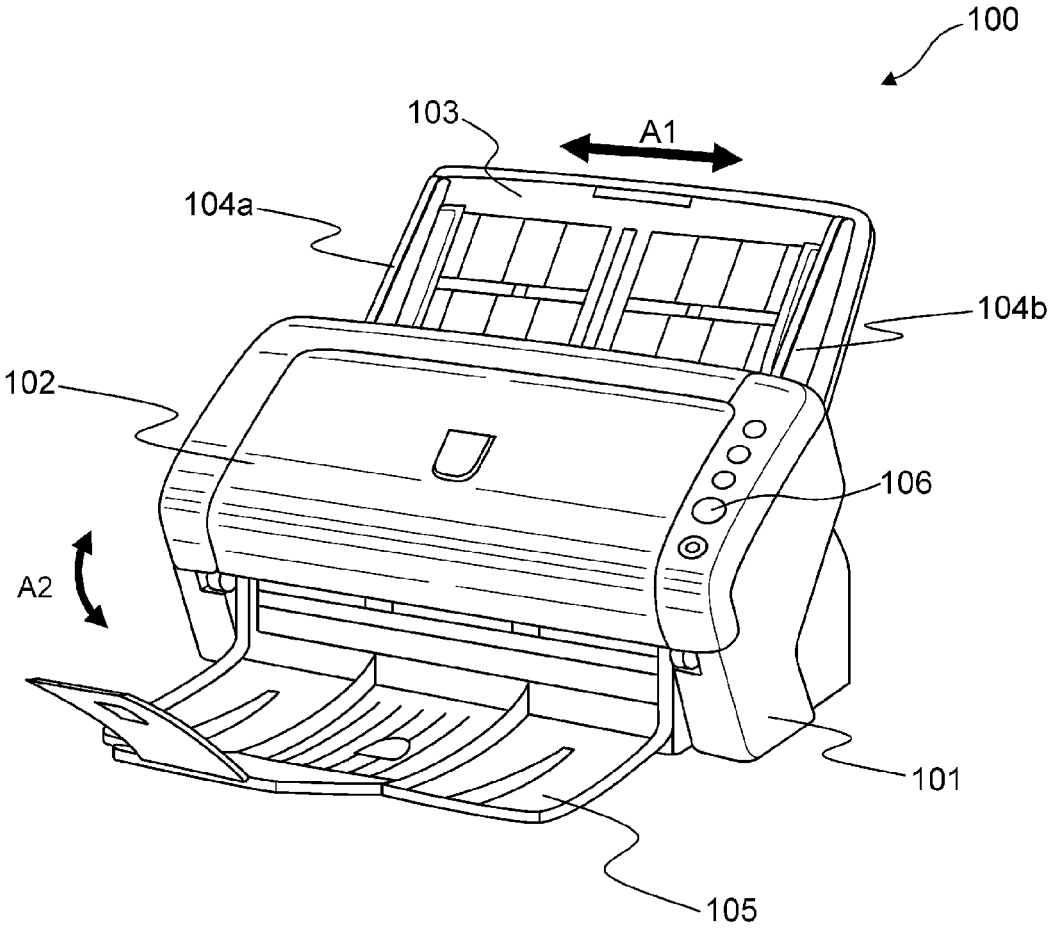
FIG. 1 is a perspective view which shows a paper conveying apparatus 100 according to an embodiment.

FIG. 1 is a perspective view which shows a paper conveying apparatus 100 which is configured as an image scanner, according to an embodiment.

The paper conveying apparatus 100 includes a lower housing 101, an upper housing 102, a paper tray 103, an ejection tray 105, an operation button 106, etc.

The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which are movable in a direction A1 perpendicular to a conveyance direction of the paper, that is, to the left and right directions from the conveyance direction of the paper. By positioning the side guides 104*a* and 104*b* to match with the width of the paper, it is possible to limit the width direction of the paper. Below, the side guides 104*a* and 104*b* sometimes will be referred to overall as the "side guides 104".

The ejection tray 105 is engaged with the lower housing 101 by hinges so as to be able to pivot in the direction which is shown by an arrow mark A2. In the opened state as shown in FIG. 1, the ejected paper can be held.

The operation button 106 is arranged on the surface of the upper housing 102. If pushed, it generates and outputs an operation detection signal.

Figure 2:
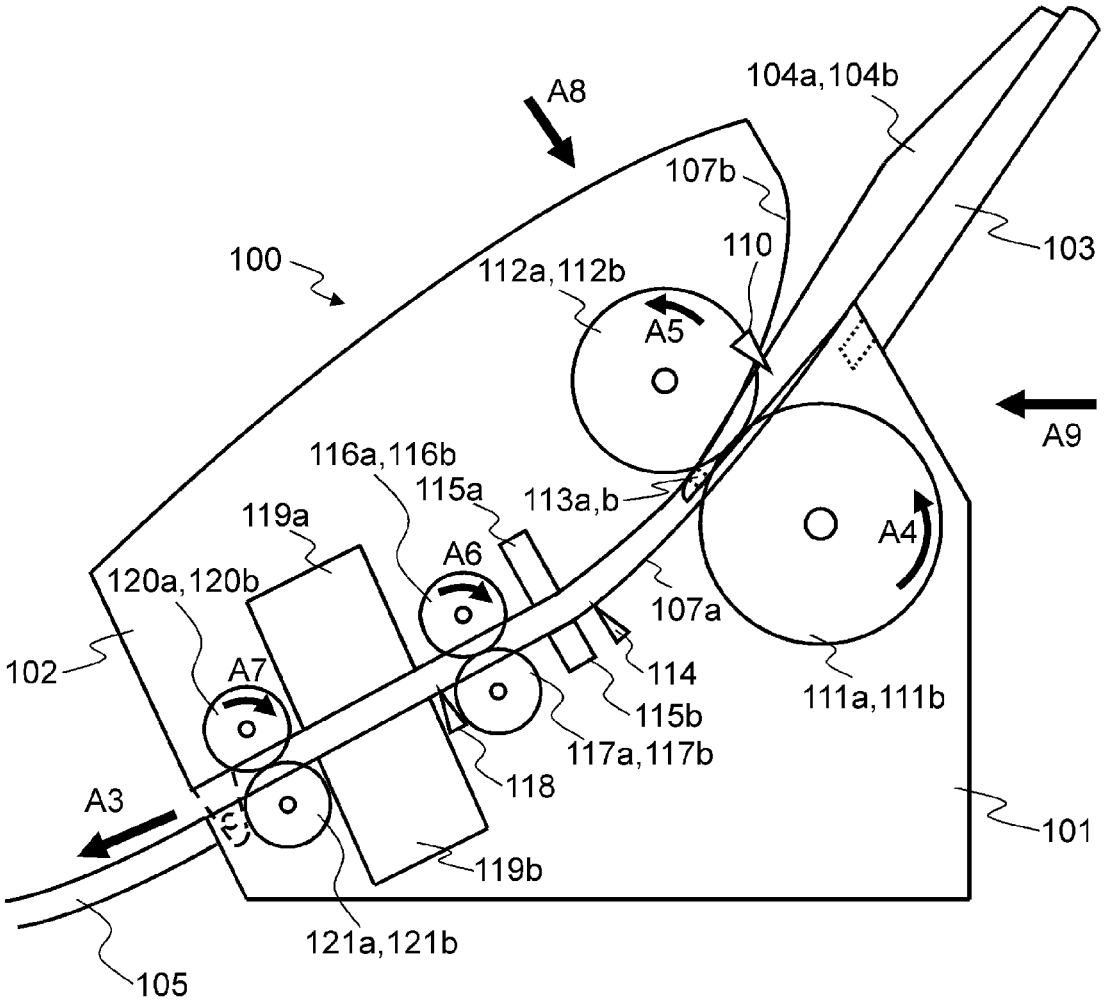
FIG. 2 is a view for explaining an example of a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first paper detector 110, paper feed rollers 111*a*, 111*b*, retard rollers 112*a*, 112*b*, microphones 113*a*, 113*b*, a second paper detector 114, an ultrasonic transmitter 115*a*, an ultrasonic receiver 115*b*, first conveyor rollers 116*a*, 116*b*, first driven rollers 117*a*, 117*b*, a third paper detector 118, a first image capture unit 119*a*, a second image capture unit 119*b*, second conveyor rollers 120*a*, 120*b*, second driven rollers 121*a*, 121*b*, etc.

Below, the paper feed rollers 111*a* and 111*b* sometimes will be referred to altogether as the "paper feed rollers 111", the retard rollers 112*a* and 112*b* sometimes will be referred to altogether as the "retard rollers 112", the first conveyor rollers 116*a* and 116*b* sometimes will be referred to altogether as the "first conveyor rollers 116", the first driven rollers 117*a* and 117*b* sometimes will be referred to overall as the "first driven rollers 117", the second conveyor rollers 120*a* and 120*b* sometimes will be referred to overall as the "second conveyor rollers 120", and the second driven rollers 121*a* and 121*b* sometimes will be referred to overall as the "second driven rollers 121".

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A3 shows the conveyance direction of the paper. Below, "upstream" means upstream of the conveyance direction A3 of the paper, while "downstream" means downstream of the conveyance direction A3 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphones 113*a* and 113*b* are examples of sound detectors, detect the sound generated by a paper during conveyance of the paper, and generate and output analog signals corresponding to the detected sound. The microphones 113*a* and 113*b* are provided at the side guides 104*a* and 104*b* so as to move in accordance with movement of the side guides 104*a* and 104*b* respectively and are arranged at the downstream side of the paper feed rollers 111 and the retard rollers 112. Below, the microphones 113*a* and 113*b* sometimes will be referred to overall as the "microphones 113".

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture unit 119*a* and the second image capture unit 119*b* and detects if there is a paper at that position. The third paper detector 118 generates and outputs a third paper detection signal which changes in signal value between a state where there is a paper at that position and a state where there is no such paper there.

The first image capture unit 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 119*a* and the second image capture unit 119*b* and read only one surface of the paper. Further, instead of a CIS, it is also possible to utilize an image capturing sensor of a reduced magnification optical system type using CCD's (charge coupled devices). Below, the first image capture unit 119*a* and the second image capture unit 119*b* will sometimes be referred to overall as the "image capture units 119".

A paper which is placed on the paper tray 103 is conveyed between the lower guide 107*a* and the upper guide 107*b* toward the paper conveyance direction A3 by rotation of the paper feed roller 111 in the direction of the arrow mark A4 of FIG. 2. The retard roller 112 rotates in the direction of the arrow mark A5 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator for separating a stack of papers for conveyance.

A paper is fed between the first conveyor roller 116 and the first driven roller 117 while being guided by the lower guide 107*a* and the upper guide 107*b*. The paper is sent between the first image capture unit 119*a* and the second image capture unit 119*b* by the first conveyor roller 116 rotating in the direction of the arrow mark A6 of FIG. 2. The paper which is read by the image capture unit 119 is ejected onto the ejection tray 105 by the second conveyor roller 120 rotating in the direction of the arrow mark A7 of the FIG. 2.

Figure 3:
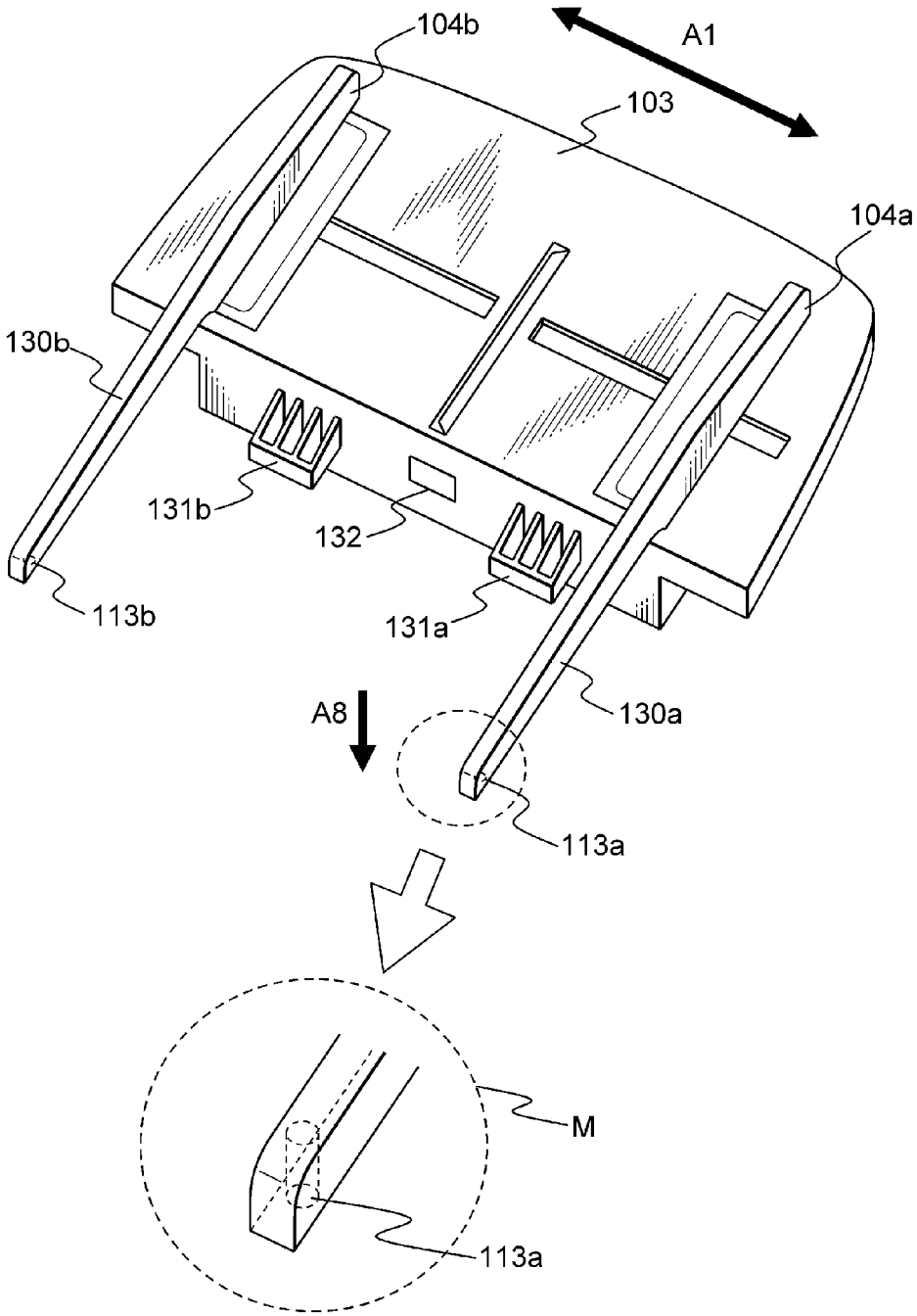
FIG. 3 is a perspective view which shows a paper tray 103 and side guides 104.

FIG. 3 is a perspective view which shows a paper tray 103 and side guides 104*a* and 104*b*.

The side guides 104*a* and 104*b* have projecting parts 130*a* and 130*b* which project towards a downstream side beyond the paper feed rollers 111 and the retard rollers 112 when the paper tray 103 is engaged with the lower housing 101. The microphones 113*a* and 113*b* are arranged at the front ends of the projecting parts 130*a* and 130*b* respectively. That is, the microphones 113*a* and 113*b* are arranged at the projecting parts 130*a* and 130*b* respectively beyond the side guide in the paper conveyance direction.

As shown in the enlarged view M of the front end of the projecting part 130*a*, the microphone 113*a* is built into the projecting part 130 with the sound detector facing the downward direction, that is, toward the direction of the arrow mark A8. Similarly, the microphone 113*b* is built in the projecting part 130*b* with the sound detector facing downward. Note that, the microphones 113*a* and 113*b* may be built in with the sound detectors facing the inside (side of conveyed paper). Further, the microphones 113*a* and 113*b* may also be attached at the outsides of the front ends of the projecting parts 130*a* and 130*b*.

The paper tray 103 has engagement members 131*a* and 131*b* for engaging the paper tray 103 with the lower housing 101. Further, the paper tray 103 has a connector 132 which electrically connects to a connector which is arranged at the lower housing 101. The microphones 113*a* and 113*b* are electrically connected to the connector 132 through not shown cables which are arranged inside the paper tray 103 and side guides 104*a* and 104*b*.

Figure 4:
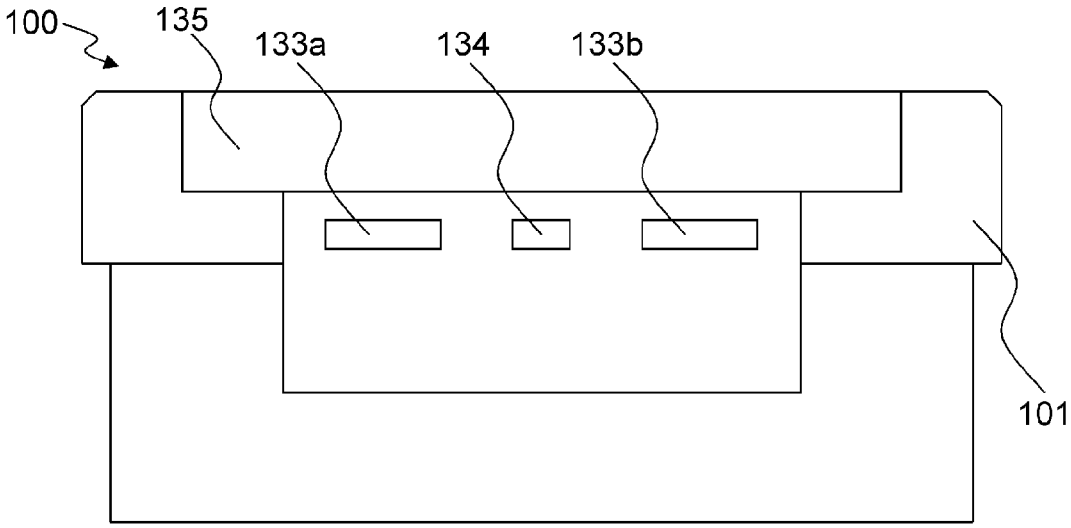
FIG. 4 is a view of a paper conveying apparatus 100 seen from the back.

FIG. 4 is a view of the paper conveying apparatus 100 in the state without the paper tray 103 engaged as seen from the back, that is, from the direction of the arrow mark A9 of FIG. 2.

At the lower housing 101, recessed portions 133*a* and 133*b* are provided at positions which face the engagement members 131*a* and 131*b* of the paper tray 103. By making the engagement members 131*a* and 131*b* engage with the recessed portions 133*a* and 133*b*, the paper tray 103 engages with the lower housing 101. Further, the lower housing 101 has a connector 134 which electrically connects with a connector 132 of the paper tray 103. If the paper tray 103 engages with the lower housing 101, the projecting parts 130*a* and 130*b* of the side guides 104*a* and 104*b* are inserted into the conveyance path 135.

Figure 5:
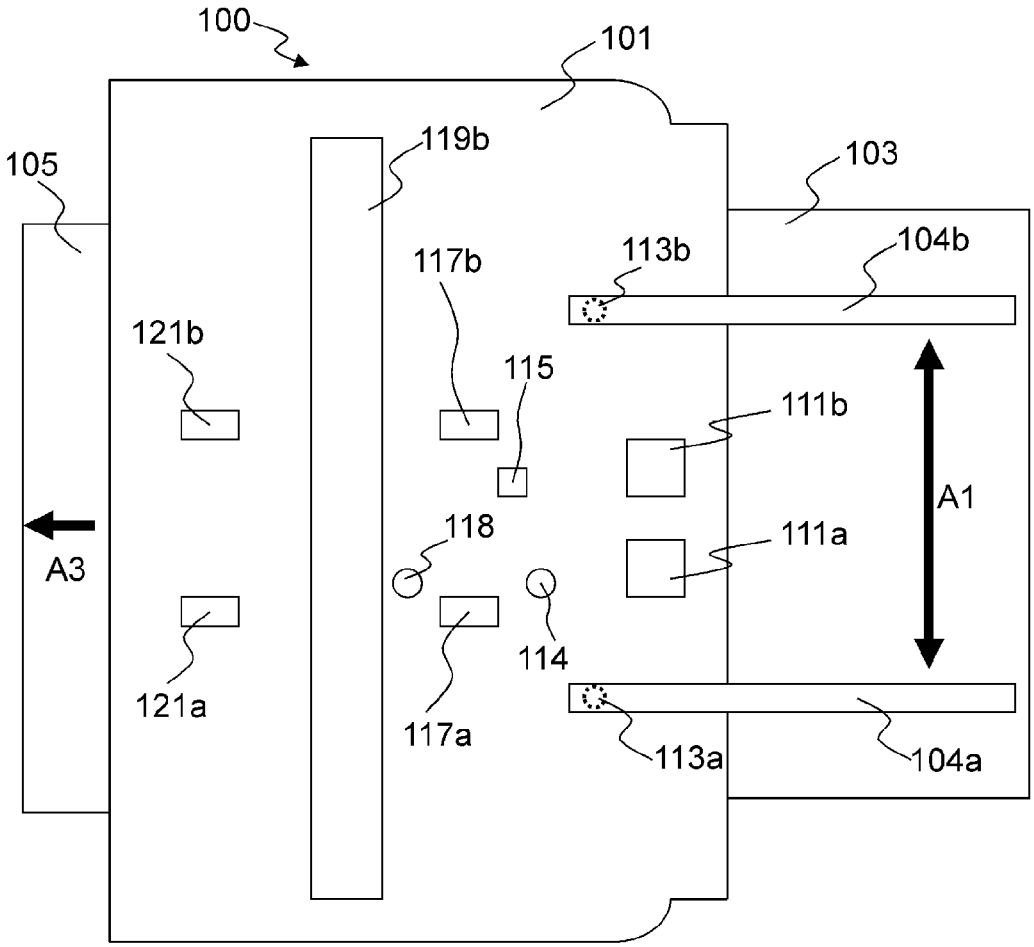
FIG. 5 is a view of a paper conveying apparatus 100 seen from above with an upper housing 102 detached.

FIG. 5 is a view of the paper conveying apparatus 100 in the state with the upper housing 102 detached as seen from the upper side, that is, from the direction of the arrow mark A8 of FIG. 2.

As shown in FIG. 5, in the state where the paper tray 103 is attached to the lower housing 101, the microphones 113*a* and 113*b* which are built into the side guides 104*a* and 104*b* respectively, are arranged at the downstream side of the paper feed rollers 111 and at the outsides of the paper feed rollers 111.

Figure 6:
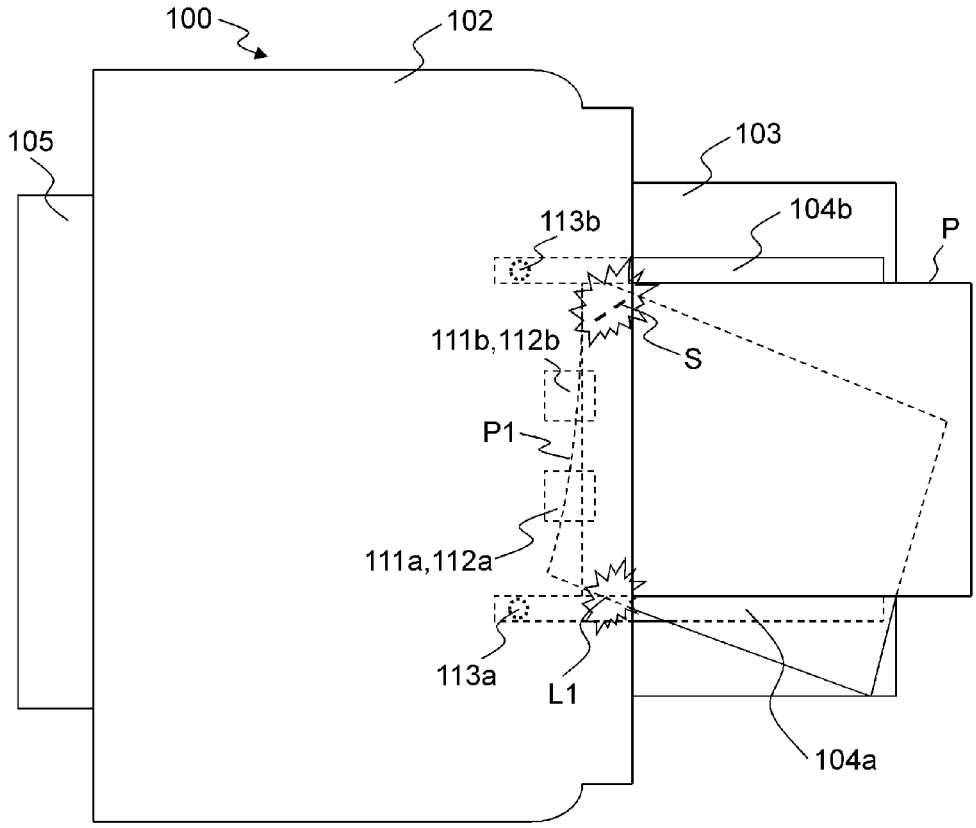
FIG. 6 is a view for explaining a jam which occurs at a paper conveying apparatus 100.

FIG. 6 is a view for explaining a jam which occurs at the paper conveying apparatus 100.

FIG. 6 shows an example of the case where a paper P which is fastened by a staple S is conveyed with its fastened part toward the downstream side. When a plurality of sheets of paper are fastened by a staple, in general one of the four corners of the paper is fastened. If the paper P which is fastened by the staple S ends up being conveyed by the paper conveying apparatus 100 with its fastened part toward the downstream side, only the sheet P1 which contacts the paper feed rollers 111 in the paper P will be attempted to be conveyed by the paper feed rollers 111 and the retard rollers 112. However, the sheets other than the sheet P1 are fastened by the staple S, so are not conveyed.

Therefore, the sheet P1 pivots about the staple S, and the back end of the sheet P1 ends up trying to ride over the side guide 104*a* on the paper tray 103. If the sheet P1 pivots further, the end part of the sheet P1 strikes the side guide 104*a* at a position L1 where the interval between the lower guide 107*a* and the side guide 104*a* becomes narrower, and a loud sound is generated. Further, the sheet P1 becomes twisted or wrinkled even at the position L2 around the part which is fastened by the staple S and a loud sound is generated. That is, when a jam occurs at a paper P which is fastened by a staple S, a loud sound is generated at positions close to the two ends of the paper in the direction which perpendicularly intersects the conveyance direction of the paper.

On the other hand, when a paper has a wrinkle, even if a jam does not occur, when the paper passes between the paper feed rollers 111 and the retard rollers 112, the wrinkle causes a loud sound to be generated.

Therefore, to effectively detect the sound which is generated by a jam of a paper P which is fastened by a staple S, it is preferable that microphones are arranged at positions close to the two ends of the paper in a direction which perpendicularly intersects the conveyance direction of the paper. Further, to prevent the sound which is generated due to a wrinkle from being detected as much as possible, it is preferable that the microphones are arranged at positions far from the paper feed rollers 111 and retard rollers 112, which are arranged near the center of the paper, in a direction which perpendicularly intersects the conveyance direction of the paper. Furthermore, to prevent sound which is generated outside of the housing of the paper conveying apparatus 100 in the conveyance direction of the paper from being detected, it is preferable that the microphones are arranged downstream of the paper feed rollers 111 and retard rollers 112.

The positions of the two ends of a paper which is conveyed differ depending on the size of the paper, so if placing the microphones inside the paper conveying apparatus at fixed positions, it would not be possible to suitably detect sounds which are generated at the two end parts of papers of various sizes.

As opposed to this, in the paper conveying apparatus 100, the microphones 113 move along with the side guides 104, so no matter what the size of the conveyed paper, the microphones 113 are arranged at positions close to the two end parts of the paper. Furthermore, the microphones 113 are arranged at positions separated by a certain degree from the paper feed rollers 111 and retard rollers 112. For this reason, the paper conveying apparatus 100 can effectively detect sound which is generated due to a jam of a paper which is fastened by a staple while can suppress detection of a sound which is generated due to a wrinkle.

In the configuration of the paper conveying apparatus 100, the microphones 113 also detect some of the sound which is generated due to a wrinkle, but the ratio of the sound which is generated due to a wrinkle to the sound which is generated due to a jam of a paper which is fastened by a staple becomes small. The above-mentioned "suppress detection of a sound which is generated due to a wrinkle" means reducing this ratio. Note that, the paper conveying apparatus 100 "suppresses detection of a sound which is generated due to a wrinkle", so it is possible to eliminate the effects of the sound which is generated due to a wrinkle by for example setting a threshold value for sound signals which the microphones 113 output, between the magnitude of the sound which is generated due to a jam of a paper which is fastened by a staple and the magnitude of the sound which is generated due to a wrinkle, and cut the components of that threshold value or less.

Furthermore, in the paper conveying apparatus 100, the paper tray 103 is provided with projecting parts 130 which project towards the downstream side of the paper feed rollers 111 and the retard rollers 112 and arranges microphones 113 at their front ends, so prevents detection of sound which is generated outside of the housing of the paper conveying apparatus 100 as much as possible.

Figure 7:
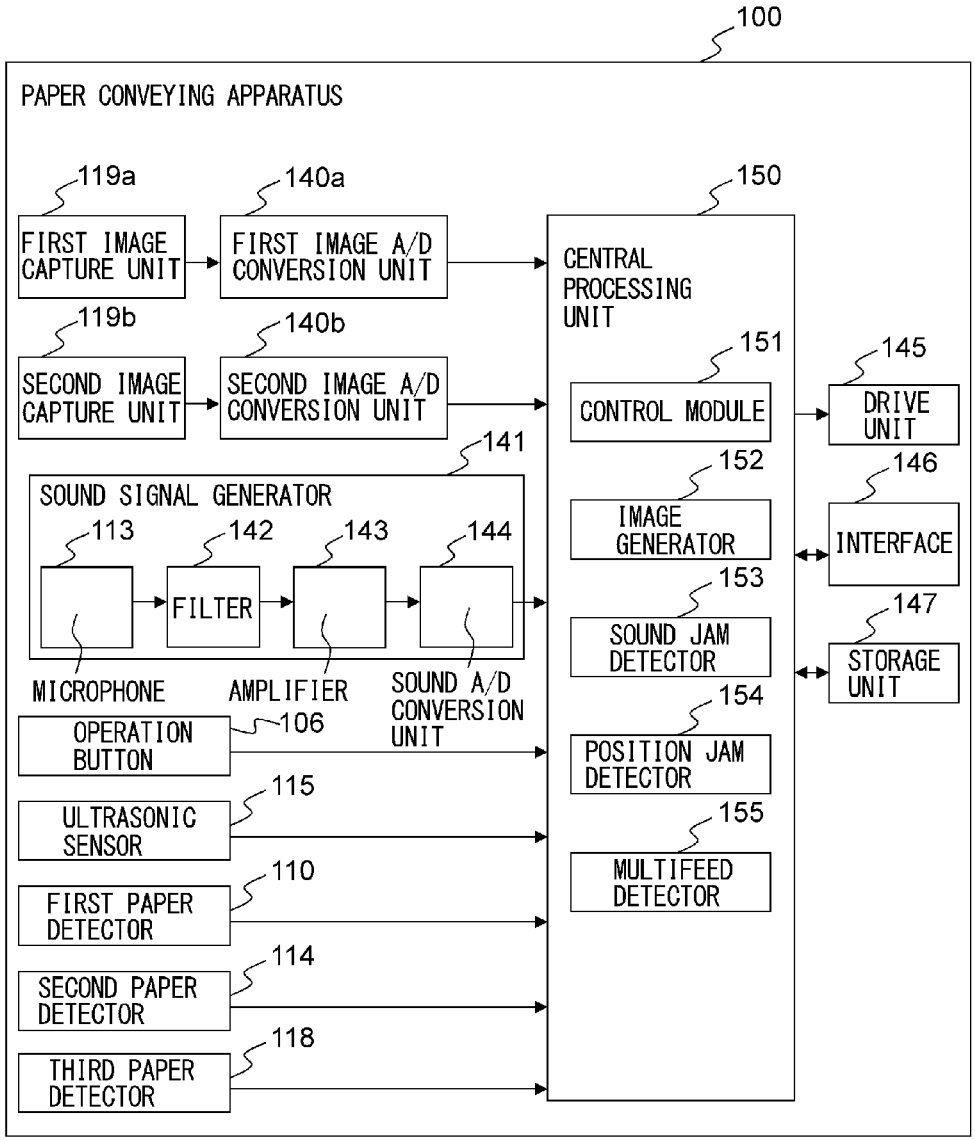
FIG. 7 is an example of a block diagram which shows a schematic configuration of a paper conveying apparatus 100.

FIG. 7 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a sound signal generator 141, a drive unit 145, an interface 146, a storage unit 147, a central processing unit 150, etc.

The first image A/D conversion unit 140*a* converts an analog image signal which is output from the first image capture unit 119*a* from an analog to digital format to generate digital image data which it then outputs to the central processing unit 150. Similarly, the second image A/D conversion unit 140*b* converts the analog image signal which is output from the second image capture unit 119*b* from an analog to digital format to generate digital image data which it then outputs to the central processing unit 150. Below, these digital image data will be referred to as the "read image".

The sound signal generator 141 includes a microphone 113, a filter 142, an amplifier 143, a sound A/D conversion unit 144, etc., and generates a sound signal. The filter 142 applies a bandpass filter which passes a predetermined frequency band of a signal to an analog signal which is output from the microphone 113 and outputs it to the amplifier 143. The amplifier 143 amplifies the signal which is output from the filter 142 and outputs it to the sound A/D conversion unit 144. The sound A/D conversion unit 144 converts the analog signal which is output from the amplifier 143 to a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 113, while the filter 142, the amplifier 143, and the sound A/D conversion unit 144 may be provided outside of the sound signal generator 141. Further, the sound signal generator 141 may include only the microphone 113 and the filter 142 or only the microphone 113, the filter 142, and the amplifier 143.

The drive unit 145 includes one or more motors and uses control signals from the central processing unit 150 to rotate the paper feed roller 111, retard roller 112, first conveyor roller 116, and second conveyor roller 120 and operate to convey a paper.

The interface 146 has, for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read image.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, microphone 113, second paper detector 114, ultrasonic sensor 115, third paper detector 118, first image capture unit 119*a*, second image capture unit 119*b*, first image A/D conversion unit 140*a*, second image A/D conversion unit 140*b*, sound signal generator 141, drive unit 145, interface 146, and storage unit 147 and controls these units.

The central processing unit 150 control a drive operation of the drive unit 145, control a paper read operation of the image capture unit 119, etc., to acquire a read image. Further, the central processing unit 150 has a control module 151, an image generator 152, a sound jam detector 153, a position jam detector 154, a multifeed detector 155, etc. These units are functional modules which are realized by software which operate on a processor. Note that, these units may be comprised of respectively independent integrated circuits, a microprocessor, firmware, etc.

Figure 8:
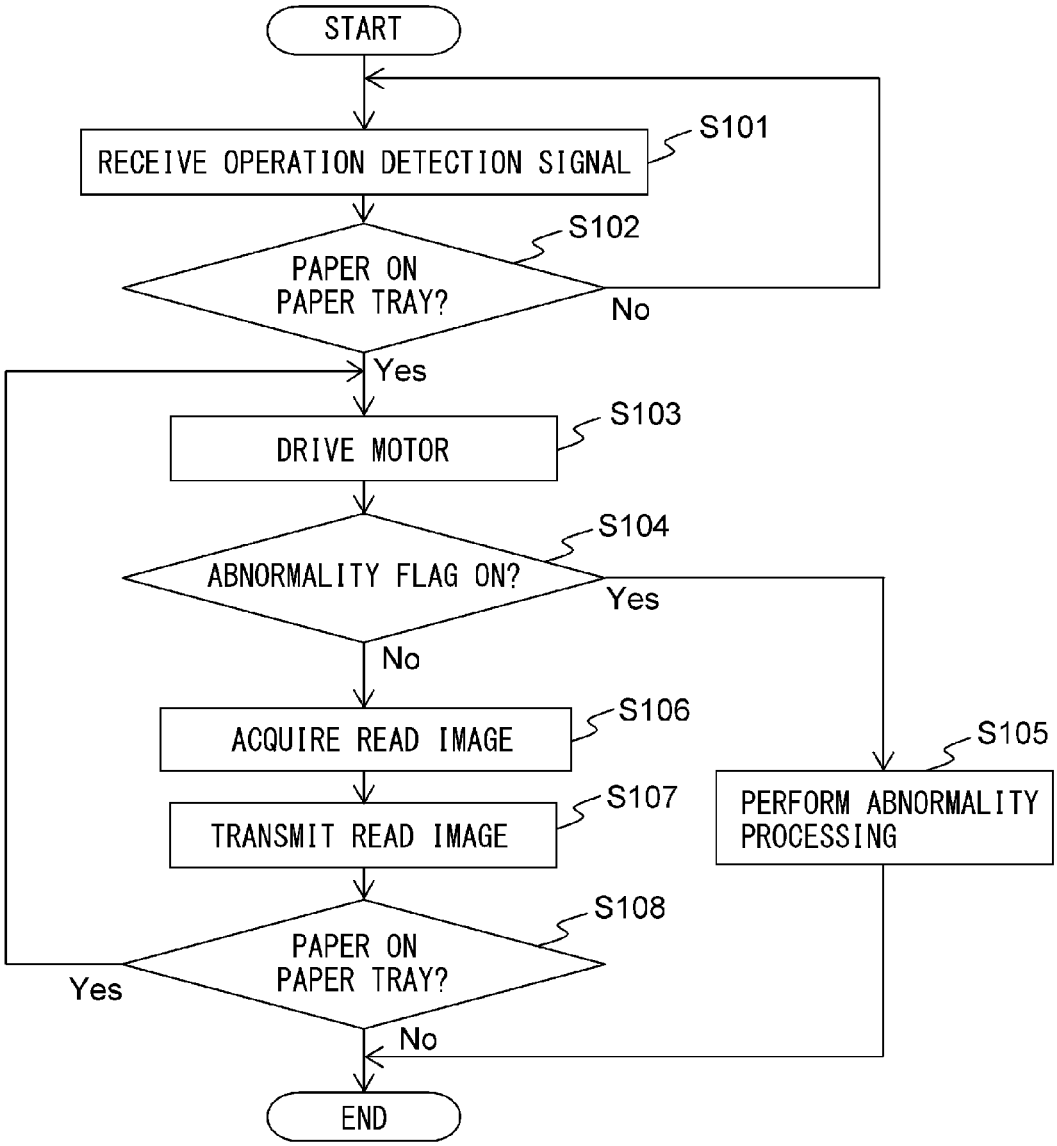
FIG. 8 is a flow chart which shows an example of operation of overall processing of a paper conveying apparatus 100.

FIG. 8 is a flow chart which shows an example of operation of overall processing of the paper conveying apparatus 100.

Below, referring to the flow chart which is shown in FIG. 8, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines if the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 116, and second conveyor roller 120 and convey the paper (step S103).

Next, the control module 151 determines if an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 119*a* and the second image capture unit 119*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 uses the first paper detection signal which was received from the first paper detector 110 as the basis to determine if the paper tray 103 has a paper remaining thereon (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 9:
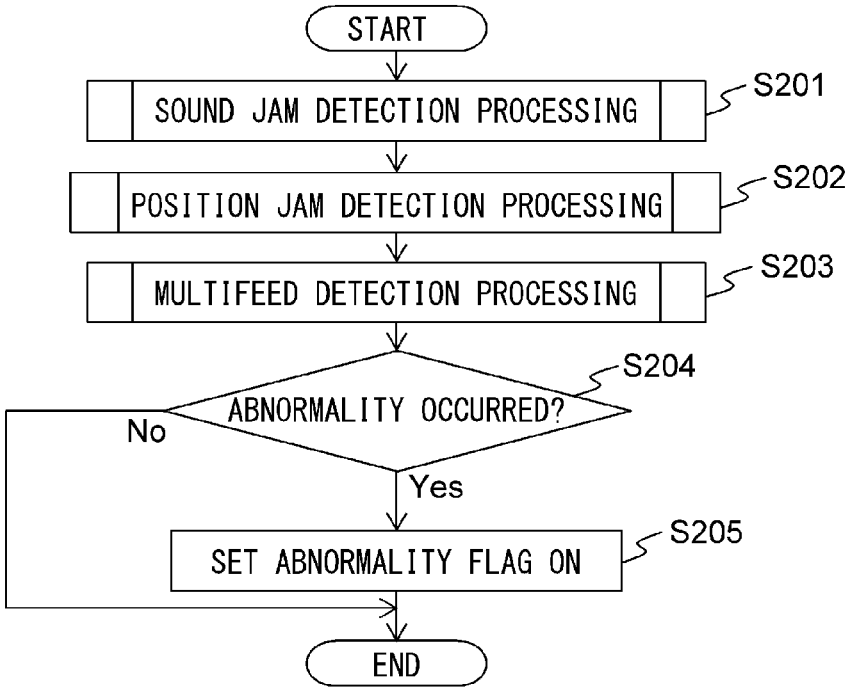
FIG. 9 is a flow chart which shows an example of an abnormality detection of the paper conveyance.

FIG. 9 is a flow chart which shows an example of an abnormality detection of the paper conveyance of the paper conveying apparatus 100.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 uses the sound signal which was acquired from the sound signal generator 141 as the basis to determine if a jam has occurred. Below, sometimes a jam which is determined to exist by the sound jam detector 153 based on a sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 115. Details of the multifeed detection processing will be explained later.

Next, the control module 151 determines if an abnormality has occurred in the paper conveyance processing (step S204). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 10:
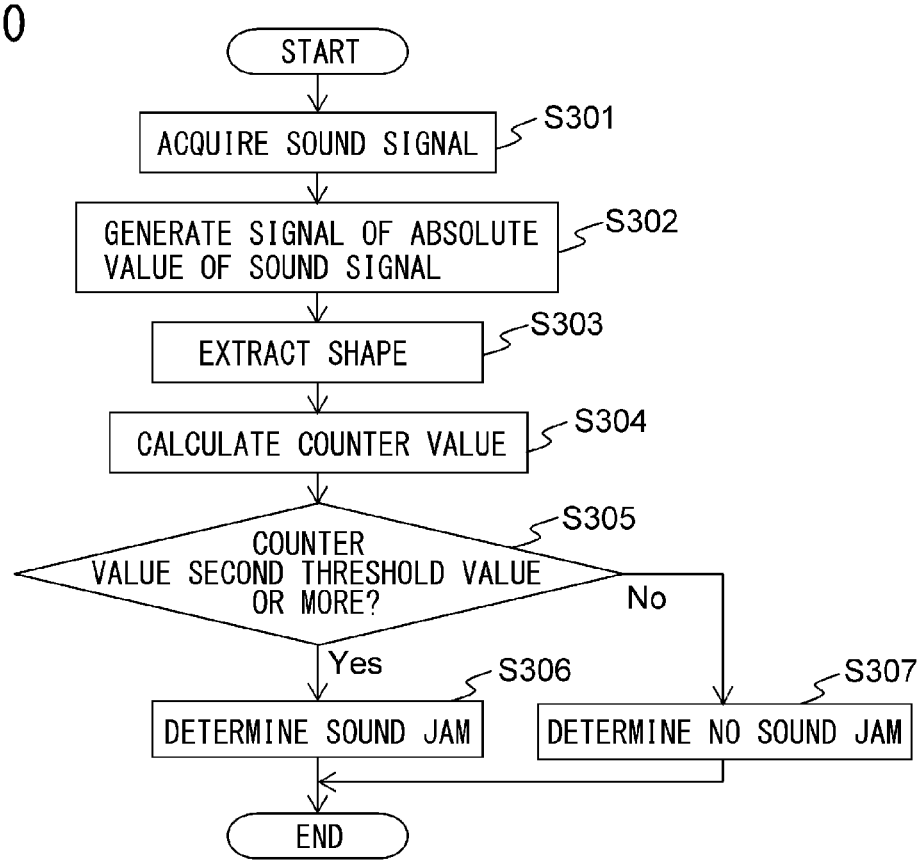
FIG. 10 is a flow chart which shows an example of operation of sound jam detection processing.

FIG. 10 is a flow chart which shows an example of operation of a sound jam detection processing.

The flow of operation which is shown in FIG. 10 is executed at step S201 of the flow chart which is shown in FIG. 9.

First, the sound jam detector 153 acquires a sound signal from the sound signal generator 141 (step S301).

Figure 11A:
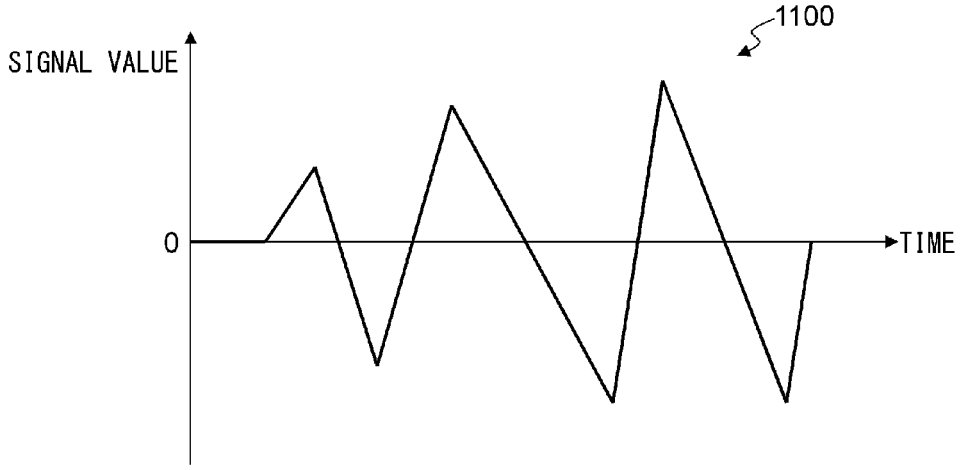
FIG. 11A is a graph which shows an example of a sound signal.

FIG. 11A is a graph which shows an example of a sound signal. The graph 1100 which is shown in FIG. 11A shows a sound signal which is acquired from the sound signal generator 141. The abscissa of graph 1100 shows the time, while the ordinate shows the signal value of the sound signal.

Next, the sound jam detector 153 generates a signal of the absolute value of the sound signal received from the sound signal generator 141 (step S302).

Figure 11B:
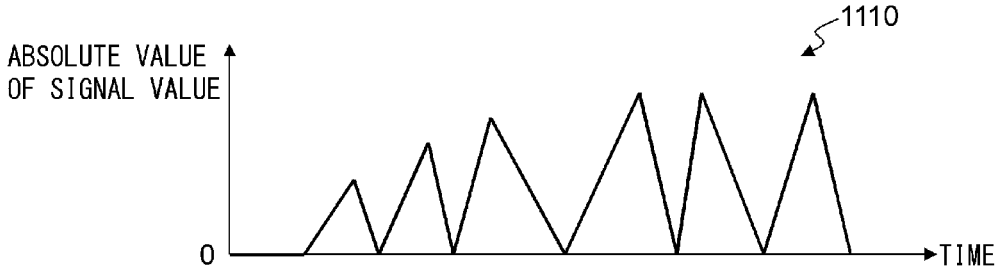
FIG. 11B is a graph which shows an example of a signal of an absolute value of a sound signal.

FIG. 11B is a graph which shows an example of the signal of the absolute value of the sound signal. The graph 1110 which is shown in FIG. 11B shows the signal of the absolute value of the sound signal of the graph 1100. The abscissa of graph 1110 shows the time, while the ordinate shows the signal of the absolute value of the sound signal.

Next, the sound jam detector 153 extracts the shape of a signal of the absolute value of the sound signal (step S303). The sound jam detector 153 extracts the envelope as the shape of the signal of the absolute value of the sound signal.

Figure 11C:
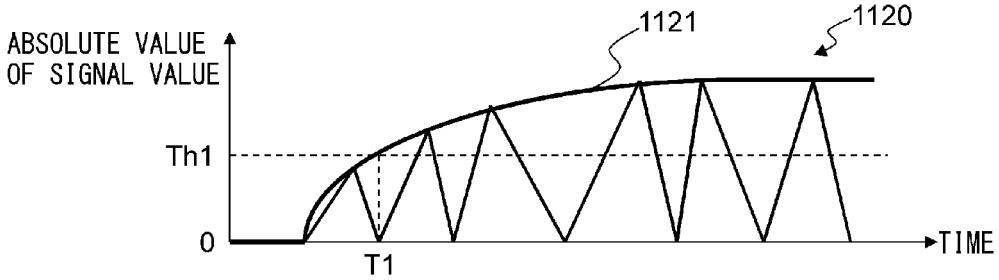
FIG. 11C is a graph which shows an example of a shape of a signal of an absolute value of a sound signal.

FIG. 11C is a graph which shows an example of the shape of a signal of the absolute value of the sound signal. The graph 1120 which is shown in FIG. 11C shows the envelope 1121 of the signal of the absolute value of the sound signal of the graph 1110. The abscissa of the graph 1120 shows the time, while the ordinate shows the absolute value of the signal value of the sound signal.

Next, the sound jam detector 153 calculates a counter value which it increases when the shape of the signal of the absolute value of the sound signal is a first threshold value Th1 or more and which it decreases when it is less than the first threshold value Th1 (step S304). The sound jam detector 153 determines if the value of the envelope 1121 is the first threshold value Th1 or more at each predetermined time interval (for example, sampling intervals of sound signal), increments the counter value when the value of the envelope 1121 is the first threshold value Th1 or more, and decrements the counter value when it is less than the first threshold value Th1. As explained in the explanation of FIG. 6, the first threshold value Th1 is set to a value between the magnitude of the sound which is generated due to a jam of a paper which is fastened by a staple and the magnitude of the sound which is generated due to a wrinkle.

Figure 11D:
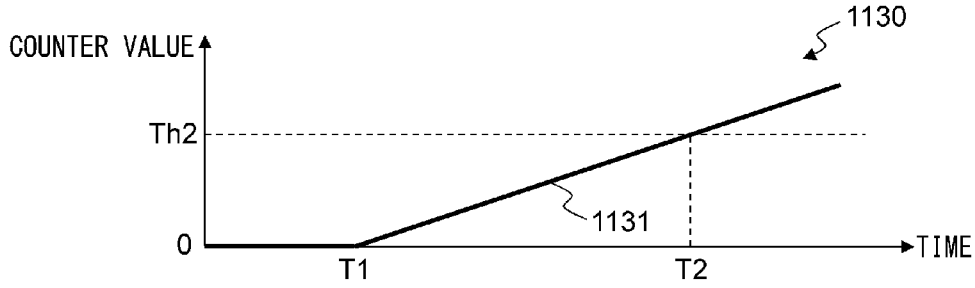
FIG. 11D is a graph which shows an example of a counter value.

FIG. 11D is a graph which shows an example of the counter value which is calculated for the shape of the signal of the absolute value of the sound signal. The graph 1130 which is shown in FIG. 11D expresses the counter value which is calculated for the envelope 1121 of the graph 1120. The abscissa of the graph 1120 shows the time, while the ordinate shows the counter value.

Next, the sound jam detector 153 determines if the counter value is a second threshold value Th2 or more (step S305). The sound jam detector 153 determines that a sound jam has occurred if the counter value is the second threshold value Th2 or more (step S306), determines that a sound jam has not occurred if the counter value is less than the second threshold value Th2 (step S307), and then ends the series of steps.

In FIG. 11C, the envelope 1121 is the first threshold value Th1 or more at the time T1 and thereafter does not become less than the first threshold value Th1. For this reason, as shown in FIG. 11D, the counter value increases from the time T1 and becomes the second threshold value Th2 or more at the time T2, then the sound jam detector 153 determines that a sound jam has occurred.

Note that, at step S303, instead of acquiring the envelope as the shape of the signal of the absolute value of the sound signal, the sound jam detector 153 may acquire a signal of the peak hold for the signal of the absolute value of the sound signal (below, referred to as the "peak hold signal"). For example, the central processing unit 150 holds the local maximum value of the signal of the absolute value of the sound signal for exactly a predetermined hold period and then attenuates it by a constant attenuation rate to acquire the peak hold signal.

Figure 12A:
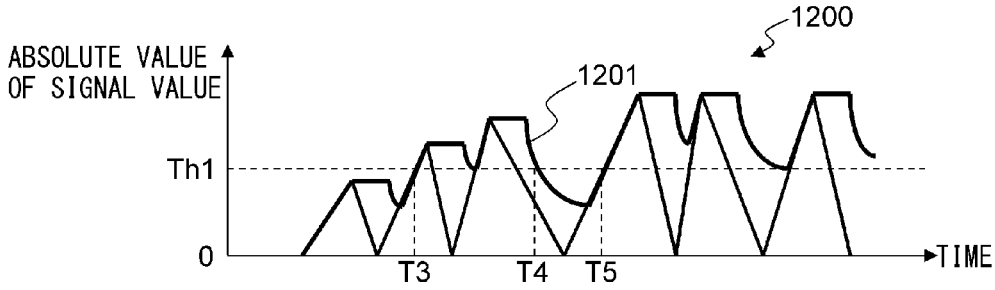
FIG. 12A is a view for explaining processing for detection of occurrence of a jam.
Figure 12B:
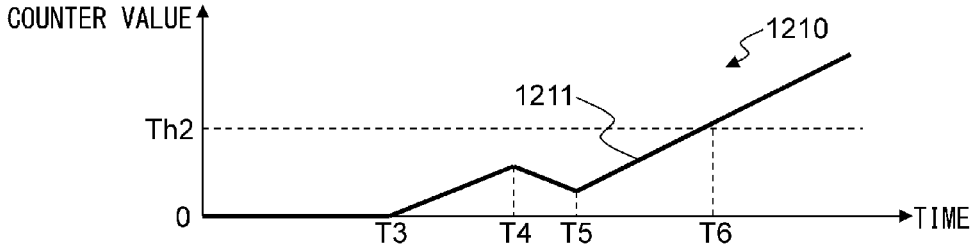
FIG. 12B is a view for explaining processing for detection of occurrence of a jam.

FIG. 12A and FIG. 12B are views for explaining the processing for acquiring the peak hold signal from the sound signal and determining if a sound jam has occurred.

The graph 1200 which is shown in FIG. 12A expresses the peak hold signal 1201 for the signal of the absolute value of the sound signal of the graph 1110. The abscissa of the graph 1200 shows the time, while the ordinate shows the absolute value of the signal value of the sound signal.

The graph 1210 which is shown in FIG. 12B shows the counter value which was calculated for the peak hold signal 1201 of the graph 1200. The abscissa of the graph 1210 shows the time, while the ordinate shows the counter value. The peak hold signal 1201 becomes the first threshold value Th1 or more at the time T3, becomes less than the first threshold value Th1 at the time T4, again becomes the first threshold value Th1 or more at the time T5, and does not become less than the first threshold value Th1 after that. For this reason, as shown in FIG. 12B, the counter value increases from the time T3, decreases from the time T4, again increases from the time T5, and becomes the second threshold value Th2 or more at the time T6, so it is determined that a sound jam has occurred.

Figure 13:
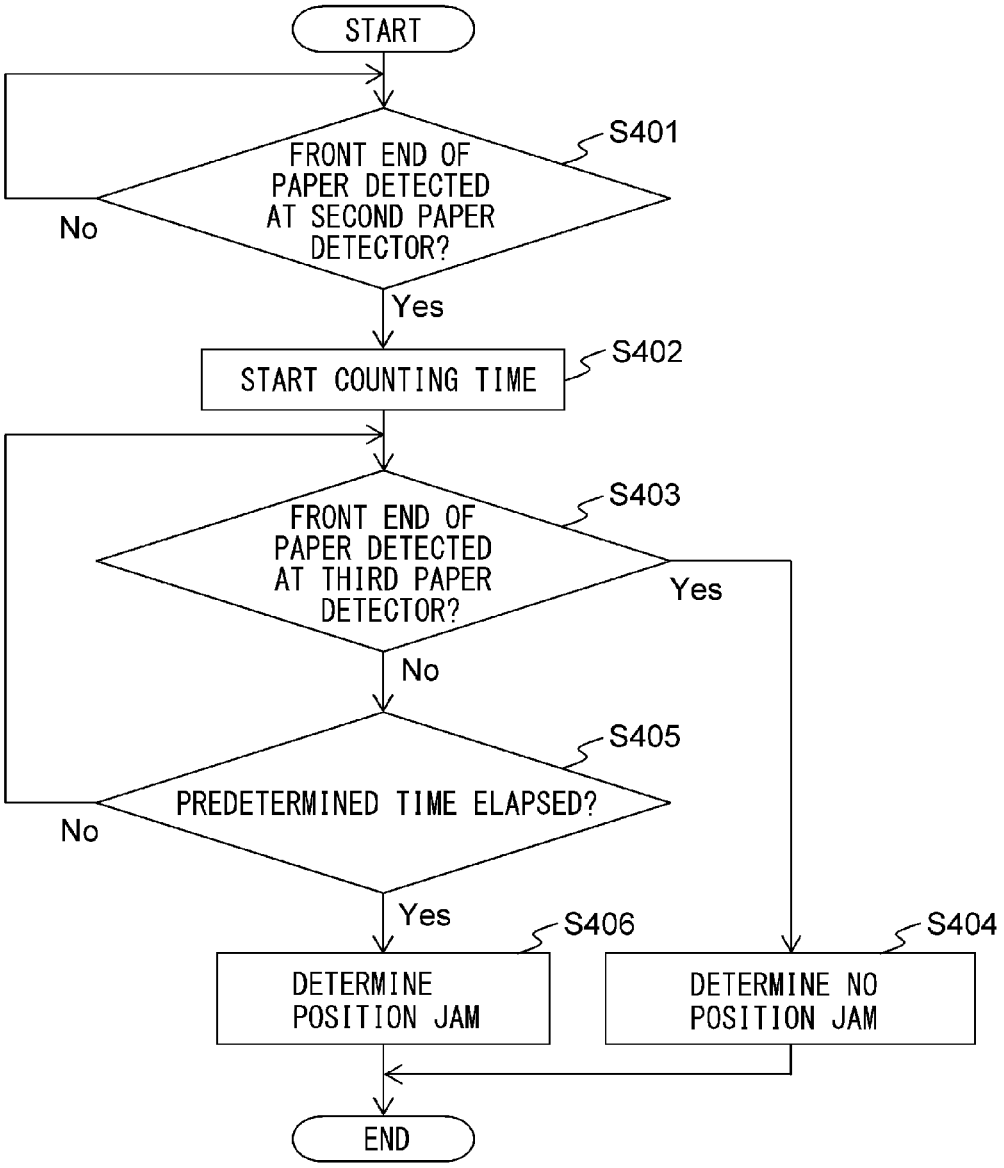
FIG. 13 is a flow chart which shows an example of operation of position jam detection processing.

FIG. 13 is a flow chart which shows an example of operation of a position jam detection processing.

The flow of operation which is shown in FIG. 13 is executed at step S202 of the flow chart which is shown in FIG. 9.

First, the position jam detector 154 stands by until the front end of the paper is detected by the second paper detector 114 (step S401). The position jam detector 154 determines that the front end of the paper is detected at the position of the second paper detector 114, that is, downstream of the paper feed roller 111 and retard roller 112 and upstream of the first conveyor roller 116 and first driven roller 117, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S402).

Next, the position jam detector 154 determines if the third paper detector 118 has detected the front end of the paper (step S403). The position jam detector 154 determines that the front end of the paper is detected at the position of the third paper detector 118, that is, downstream of the first conveyor roller 116 and first driven roller 117 and upstream of the image capture unit 119, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S404) and ends the series of steps.

On the other hand, if the third paper detector 118 detects the front end of the paper, the position jam detector 154 determines if a predetermined time (for example, 1 second) has elapsed from the start of counting time (step S405). If a predetermined time has not elapsed, the position jam detector 154 returns to the processing of step S403 and again determines if the third paper detector 118 has detected the front end of the paper. On the other hand, when a predetermined time has elapsed, the position jam detector 154 determines that position jam has occurred (step S406) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal from the third paper detector 118, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 114, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 119 does not detect the front end of a paper within a predetermined time.

Figure 14:
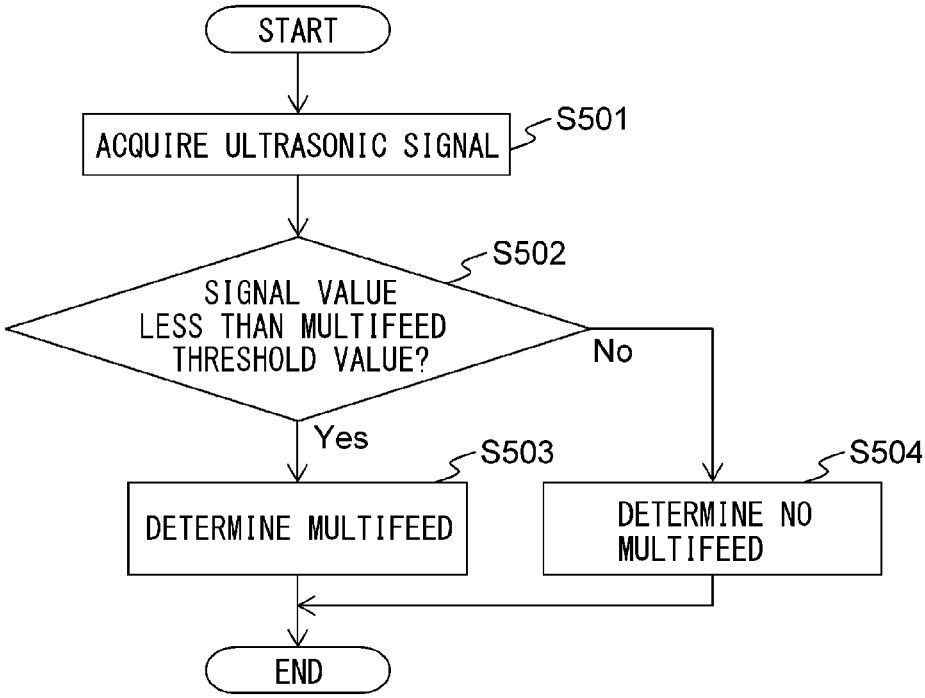
FIG. 14 is a flow chart which shows an example of operation of multifeed detection processing.

FIG. 14 is a flow chart which shows an example of operation of multifeed detection processing.

The flow of operation which is shown in FIG. 14 is executed at step S203 of the flow chart which is shown in FIG. 9.

First, the multifeed detector 155 acquires an ultrasonic signal from the ultrasonic sensor 115 (step S501).

Next, the multifeed detector 155 determines if the signal value of the acquired ultrasonic signal is less than the multifeed detection threshold value (step S502).

Figure 15:
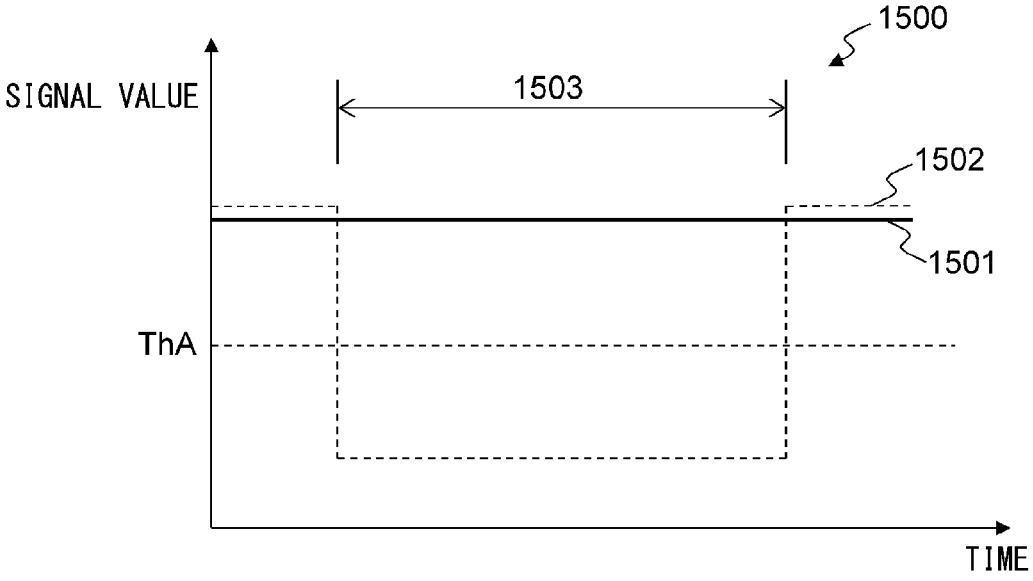
FIG. 15 is a view for explaining properties of an ultrasonic signal.

FIG. 15 is a view for explaining properties of an ultrasonic signal.

In the graph 1500 of FIG. 15, the solid line 1501 shows the characteristic of the ultrasonic signal in the case where a single paper is conveyed, while the broken line 1502 shows the characteristic of the ultrasonic signal in the case where multifeed of papers has occurred. The abscissa of the graph 1500 shows the time, while the ordinate shows the signal value of the ultrasonic signal. Due to the occurrence of multifeed, the signal value of the ultrasonic signal of the broken line 1502 falls in the section 1503. For this reason, it is possible to determine if multifeed of papers has occurred by whether the signal value of the ultrasonic signal is less than the multifeed detection threshold value ThA.

The multifeed detector 155 determines that multifeed of the papers has occurred when the signal value of the ultrasonic signal is less than the multifeed detection threshold value (step S503), determines that multifeed of the papers has not occurred when the signal value of the ultrasonic signal is the multifeed detection threshold value or more (step S504), and ends the series of steps. Note that, when multifeed detection processing is not necessary in the paper conveying apparatus, this may be omitted.

As explained above in detail, the paper conveying apparatus 100 arranges the microphones 113 so as to move together with the side guides 104 to thereby enable effective detection of the sound which is generated at the two end parts of the paper in the direction which perpendicularly intersects the paper conveyance direction at the time of occurrence of a jam regardless of the size of the paper.

Furthermore, in the paper conveying apparatus 100, the microphones 113 are arranged at positions separated from the paper feed rollers 111 and retard rollers 112 in the direction which perpendicularly intersects the paper conveyance direction, so can suppress detection of the sound which is generated due to a wrinkle. Due to this, the paper conveying apparatus 100 can eliminate the effect of sound which is generated due to a wrinkle and can precisely determine the occurrence of a jam using sound.

Furthermore, the paper conveying apparatus 100 can effectively detect sound which is generated when a paper which is fastened by a staple is conveyed, so can stop the conveyance of a paper before a sheet of the paper which is separated by the paper feed rollers 111 and retard rollers 112 is torn from the staple and can prevent the paper from being damaged.

Figure 16:
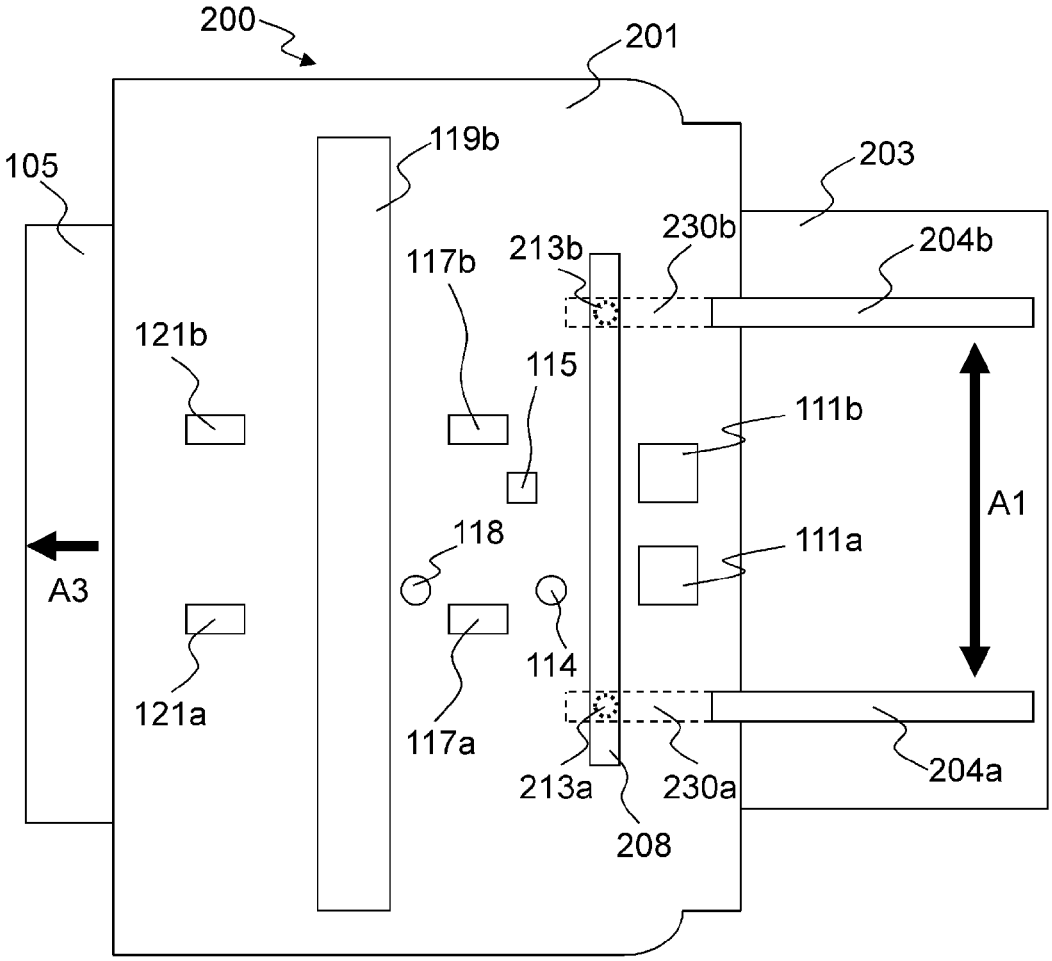
FIG. 16 is a view for explaining a conveyance route at an inside of a paper conveying apparatus 200 according to another embodiment.

FIG. 16 is a view of another paper conveying apparatus 200 in the state with the upper housing 102 detached as seen from the upper side, that is, from the direction of the arrow mark A8 of FIG. 2, according to another embodiment.

The paper conveying apparatus 200 which is shown in FIG. 16 has a lower housing 201 instead of the lower housing 101, has a paper tray 203 instead of the paper tray 103, and has side guides 204*a* and 204*b* instead of the side guides 104*a* and 104*b*, in the parts of the paper conveying apparatus 100 which is shown in FIG. 5.

Figure 17:
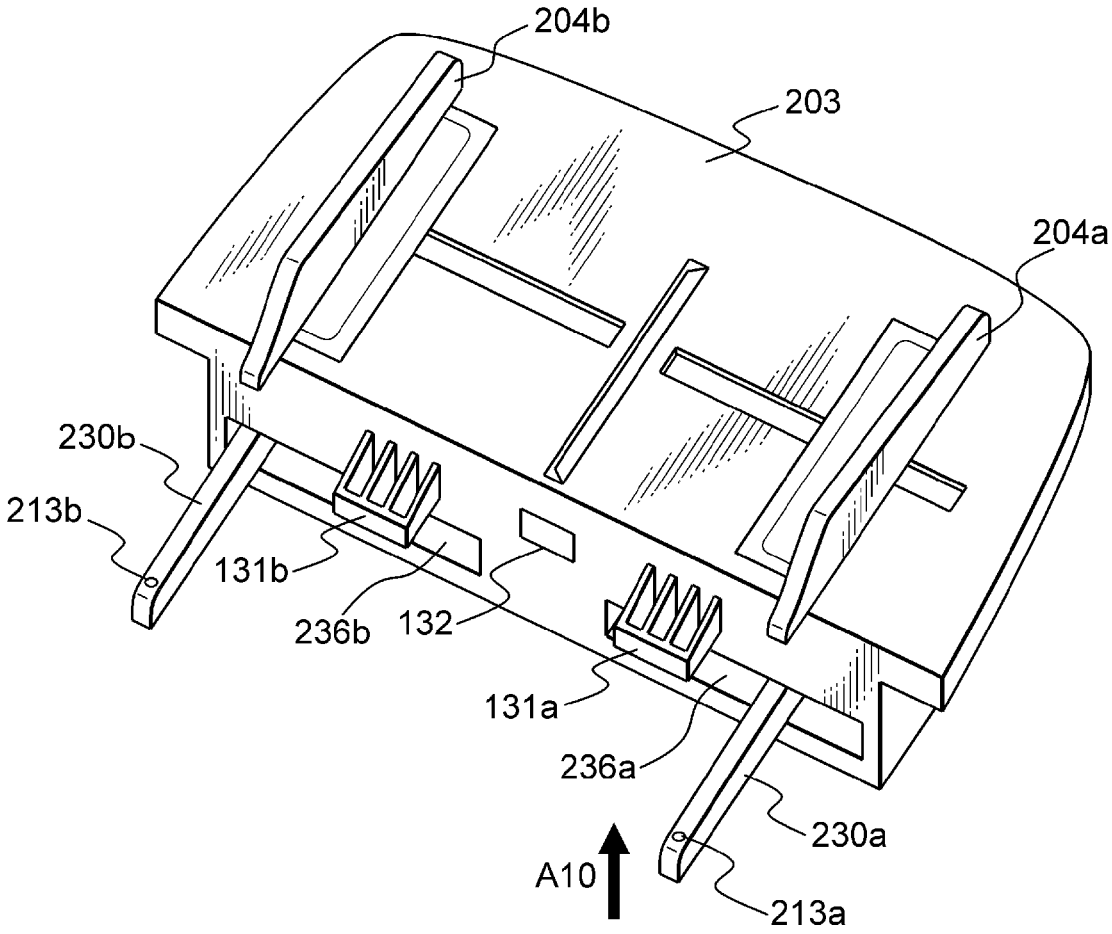
FIG. 17 is a perspective view which shows a paper tray 203 and side guides 204.

FIG. 17 is a perspective view which shows the paper tray 203 and side guides 204*a* and 204*b*.

As shown in FIG. 17, the side guides 204*a* and 204*b* have projecting parts 230*a* and 230*b* which project inside the lower housing 201 towards the downstream side of the paper feed rollers 111 and the retard rollers 112 when the paper tray 203 is engaged with the lower housing 201. At the contact surface of the paper tray 203 with the lower housing 201, holes 236*a* and 236*b* are provided so that the projecting parts 230*a* and 230*b* can move together with the side guides 204*a* and 204*b* respectively. The microphones 213*a* and 213*b* have built-in sound detector which face the upward direction, that is, the direction of the arrow mark A10, at the front ends of the projecting parts 230*a* and 230*b* respectively. Note that, the microphones 213*a* and 213*b* may also be attached at the outsides of the front ends of the projecting parts 230*a* and 230*b*.

Figure 18:
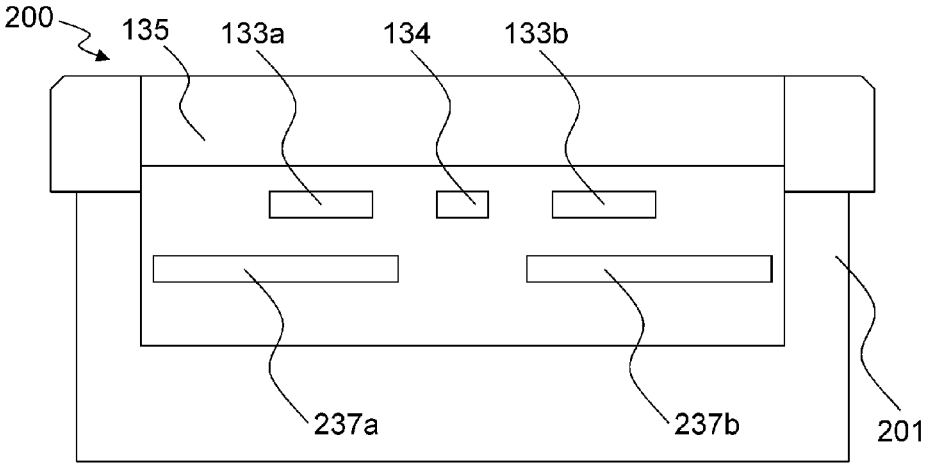
FIG. 18 is a view of a paper conveying apparatus 200 seen from the back.

FIG. 18 is a view of the paper conveying apparatus 200 in the state without the paper tray 203 engaged as seen from the back, that is, from the direction of the arrow mark A9 of FIG. 2.

The lower housing 201 is provided with holes 237*a* and 237*b* respectively at positions facing the holes 236*a* and 236*b* of the paper tray 203. Due to this, if the paper tray 203 is engaged with the lower housing 201, the projecting parts 230*a* and 230*b* of the side guides 204*a* and 204*b* are inserted to the insides of the lower housing 201, and the microphones 213*a* and 213*b* are arranged inside the lower housing 201 at the downstream side of the paper feed rollers 111 and the retard rollers 112.

Further, as shown in FIG. 16, to enable the sound generated by the paper during conveyance of the paper to be more precisely detected by the microphones 213, the lower housing 201 is provided with a hole 208 at a position facing the microphones 213.

As explained above in detail, the paper conveying apparatus 200 is configured to arrange the microphones 213 at the bottom side of the conveyance path to be able to move together with the side guides 204, so can detect sound which is generated at the two end parts of a paper in a direction which perpendicularly intersects the paper conveyance direction at the time of occurrence of a jam regardless of the size of the paper.

Figure 19:
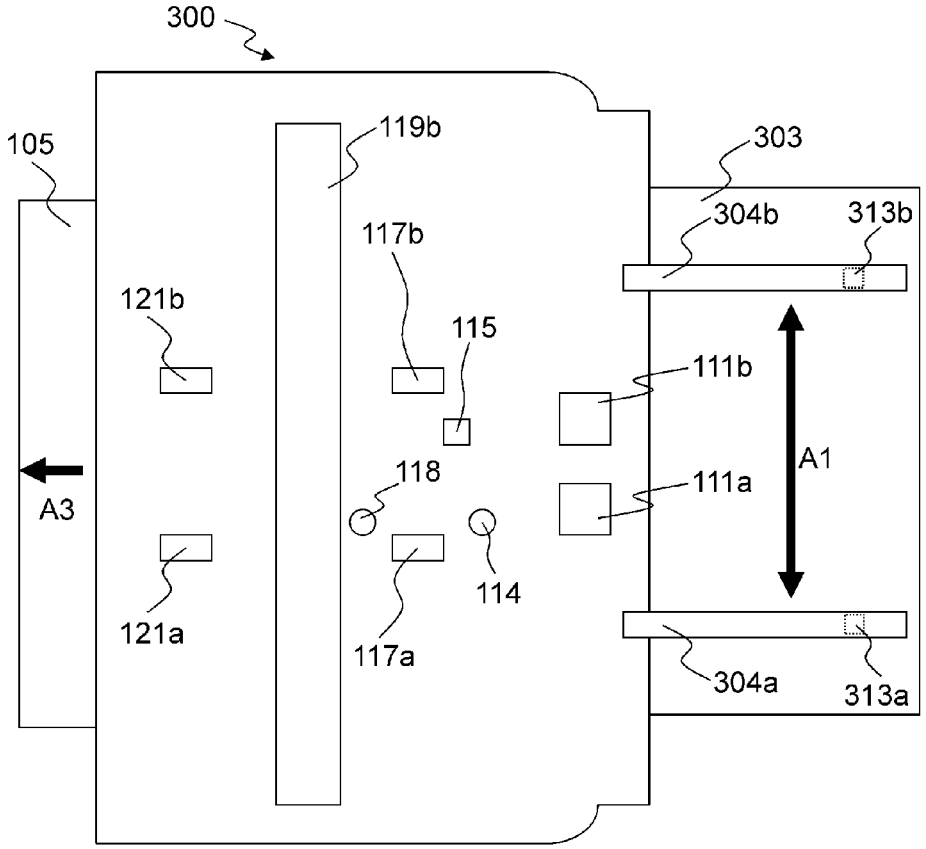
FIG. 19 is a view of a paper conveying apparatus 300 seen from above with an upper housing 102 detached.

FIG. 19 is a view of still another paper conveying apparatus 300 in the state with the upper housing 102 detached as seen from the upper side, that is, from the direction of the arrow mark A8 of FIG. 2, according to still another embodiment.

The paper conveying apparatus 300 which is shown in FIG. 19 has side guides 304*a* and 304*b* instead of the side guides 104*a* and 104*b* among the parts of the paper conveying apparatus 100 which is shown in FIG. 5.

In the paper conveying apparatus 300, the side guides 304*a* and 304*b* do not project towards the downstream side of the paper feed rollers 111 and the retard rollers 112 when the paper tray 303 is engaged with the lower housing 101. That is, the front end parts of the side guides 304*a* and 304*b* are arranged the upstream side of the paper feed rollers 111 and the retard rollers 112. The microphones 313*a* and 313*b* have built-in sound detector which face the insides (the conveyed paper side) at positions of the side guides 304*a* and 304*b* which face the paper tray 303. Note that, the side guides 304*a* and 304*b* are sufficiently high so that the back end of a paper which contacts the paper feed rollers 111 will not ride over them when a paper which is fastened by a staple is conveyed.

Figure 20:
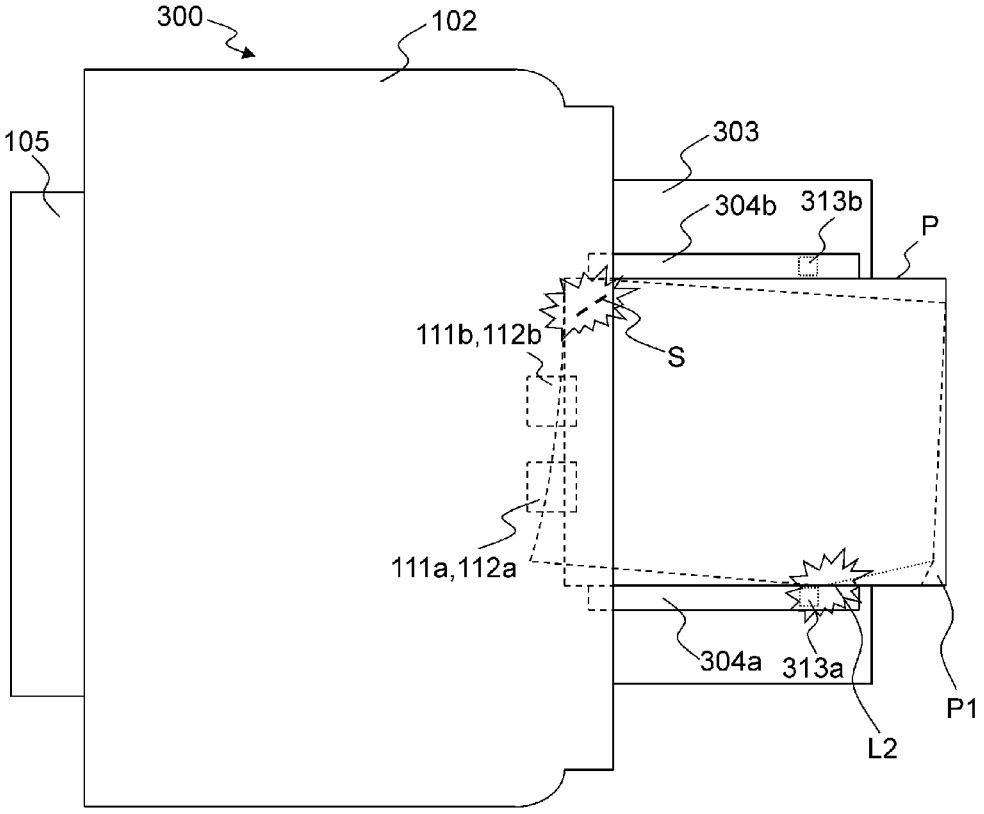
FIG. 20 is a view for explaining a jam which occurs at a paper conveying apparatus 300 according to still another embodiment.

FIG. 20 is a view for explaining a jam which occurs at the paper conveying apparatus 300.

FIG. 20 shows an example of the case where a paper P which is fastened by a staple S ends up being conveyed with the fastened part toward the downstream side. In FIG. 6, the example was explained where the back end of a sheet P1 which is contacted the paper feed rollers 111 in the paper P which is fastened by a staple S rode over the side guide 104*a* on the paper tray 303 and the end part of that sheet P1 struck the side guide 104*a* at the position L1 where the interval between the lower guide 107*a* and the side guide 104*a* becomes narrower. However, in the paper conveying apparatus 300, the side guide 304*a* is sufficiently high, so, as shown in FIG. 20, the end part of the sheet P1 which contacts the paper feed rollers 111 strikes the side guide 304*a* at the position L2 on the paper tray 303 and a loud sound is generated.

The paper conveying apparatus 300 has a microphones 313 built in at positions of the side guides 304 facing the paper tray 303, so can effectively detect sound which is generated when a paper which is fastened by a staple strikes the side guide 304*a* for all sorts of sizes of papers.

Figure 21:
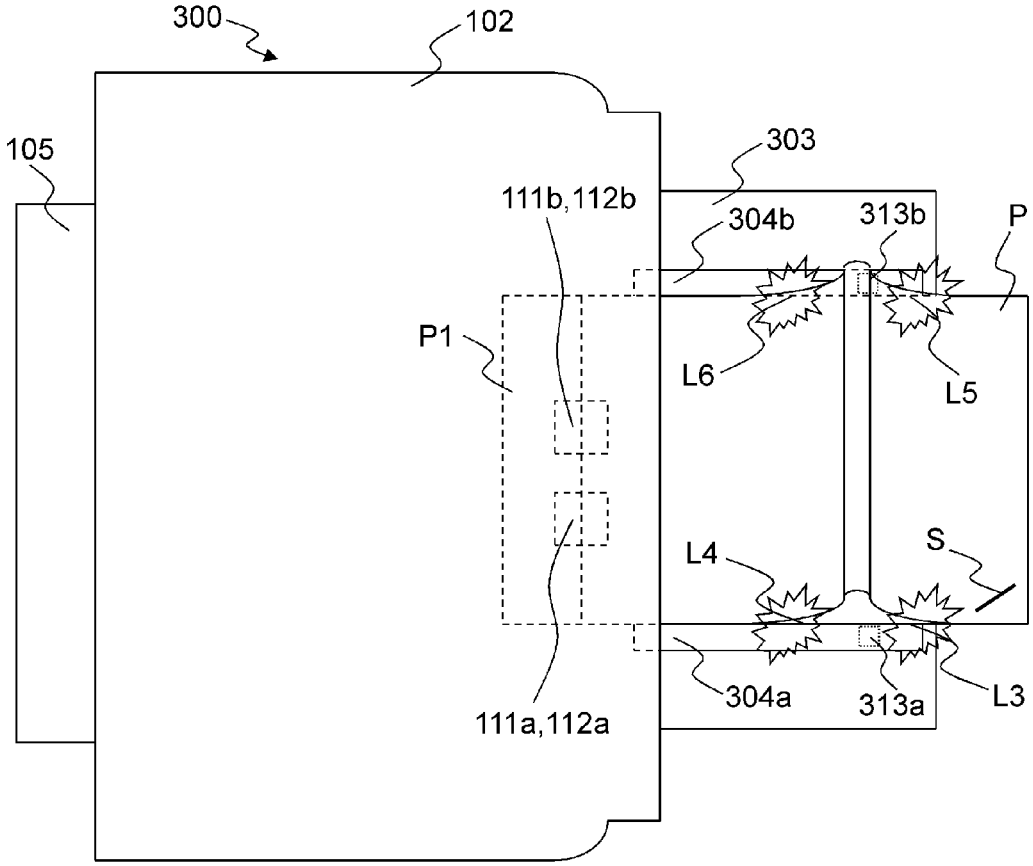
FIG. 21 is a view for explaining a jam which occurs at a paper conveying apparatus 300.

FIG. 21 is a view for explaining another jam which occurs at the paper conveying apparatus 300.

FIG. 21 shows an example of the case where a paper P which is fastened by a staple S ends up being conveyed with its fastened part toward the upstream side. In this case, only the sheet P1 which contacts the paper feed rollers 111 in the paper P is attempted to be conveyed by the paper feed rollers 111 and retard rollers 112, but the sheets other than the sheet P1 remain in a state fastened by the staple S.

For this reason, the front ends of the sheets other than the sheet P1 stop at the separator, but the back ends proceed by being pulled by the sheet P1, so the center part parts rise up. The two ends of the parts which rise up contact the side guides 304 at the positions L3, L4, L5, and L6 and generate a loud sound.

In the paper conveying apparatus 300, microphones 313 are built into the side guides 304 at positions which face the paper tray 303, so it is possible to effectively detect sound which is generated when all sorts of sizes of papers are conveyed with the part which is fastened by a staple toward the downstream side.

Figure 22:
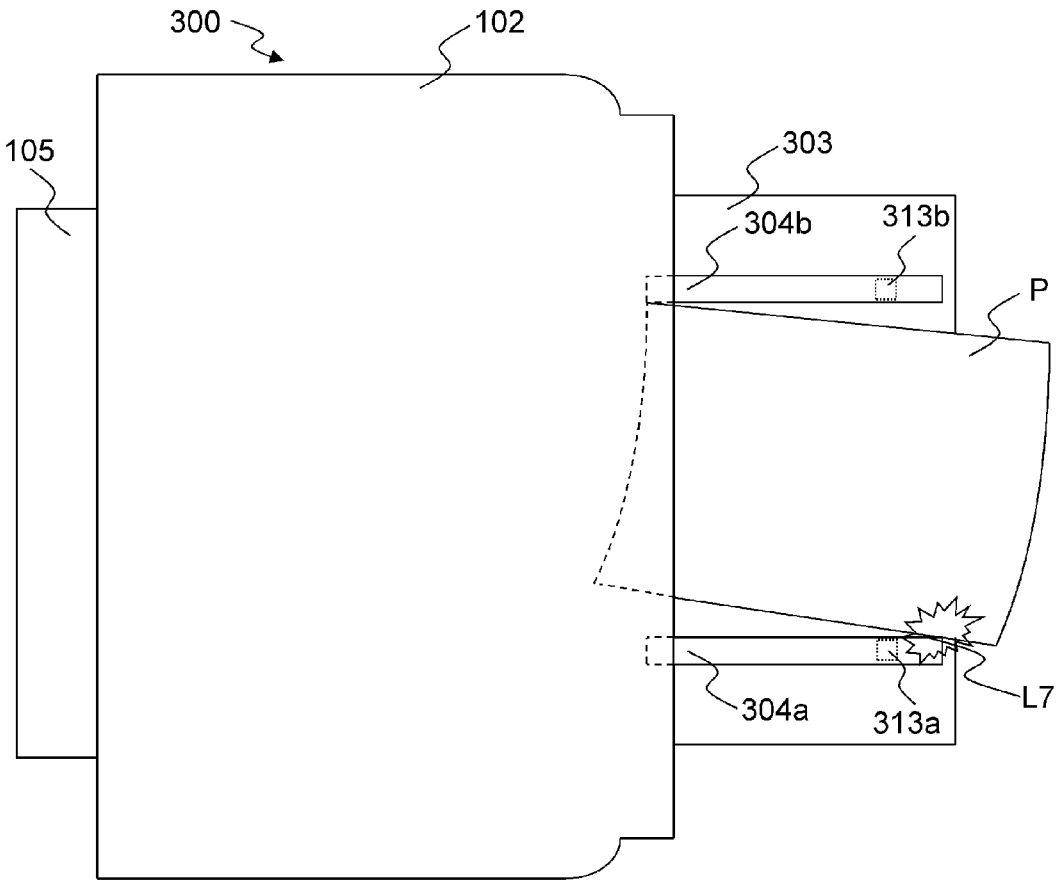
FIG. 22 is a view for explaining a jam which occurs at a paper conveying apparatus 300.

FIG. 22 is a view for explaining still other types of jams which occur in the paper conveying apparatus 300.

FIG. 22 shows the case when a paper P is conveyed at a slant with respect to the paper conveyance direction, that is, the case where a skew occurs at the time of conveyance of a paper. If a paper P is conveyed at a slant with respect to the paper conveyance direction in this way, at the position L7 on the paper tray 303, one end of the paper P contacts the side guide 304*a* and the paper P rises up whereby a loud sound is generated.

In the paper conveying apparatus 300, microphones 313 are built into the side guides 304 at positions which face the paper tray 303, so it is possible to effectively detect sound which is generated when a skew has occurred at the time of conveyance of a paper.

As explained above in detail, the paper conveying apparatus 300 is configured by arranging microphones 313 at the side guides 304 at positions which face the paper tray 303, so it is possible to effectively detect sound which is generated at the end parts of a paper in a direction which perpendicularly intersects the paper conveyance direction at the time of occurrence of a jam.

Figure 23:
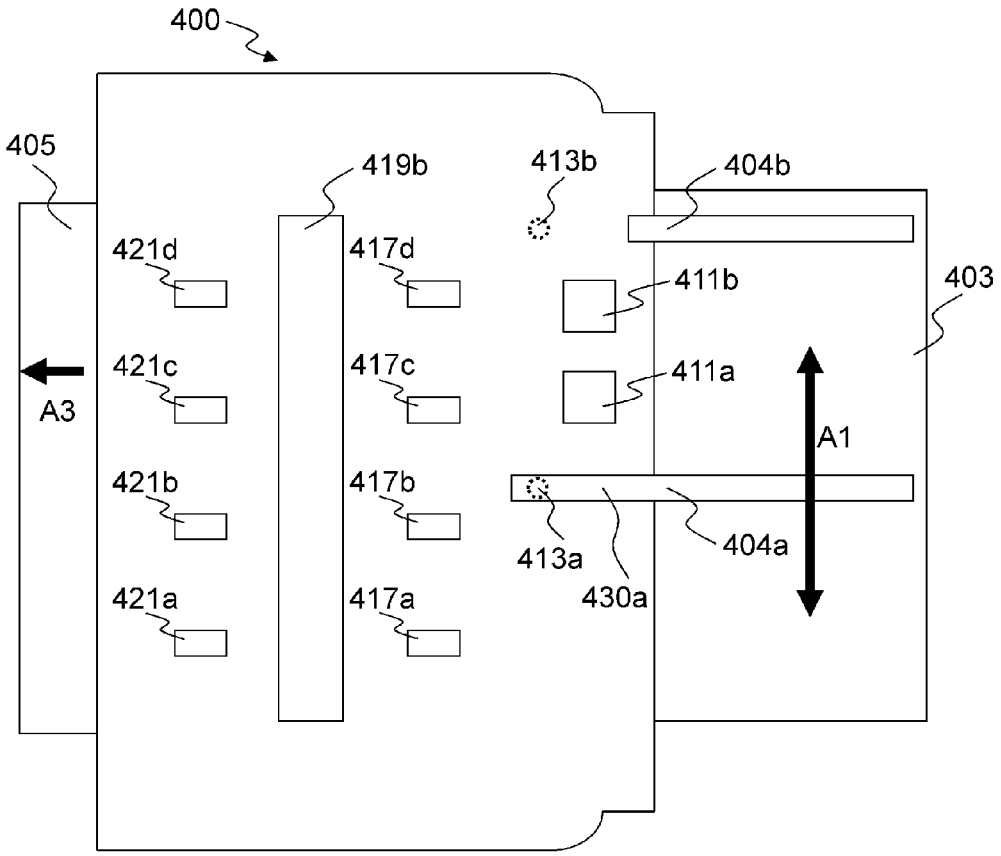
FIG. 23 is a view for explaining a conveyance route at an inside of a paper conveying apparatus 400 according to still another embodiment.

FIG. 23 is a view of still another paper conveying apparatus 400 in the state with the upper housing 102 detached as seen from the upper side, that is, from the direction of the arrow mark A8 of FIG. 2, according to still another embodiment.

The paper conveying apparatus 400 which is shown in FIG. 23 is a paper conveying apparatus of a type which feeds paper by one side reference where one of the two side guides is fixed in place.

The paper conveying apparatus 400 includes a paper tray 403, side guides 404*a*, 404*b*, paper feed rollers 411*a*, 411*b*, microphones 413*a*, 413*b*, first driven rollers 417*a*, 417*b*, 417*c*, 417*d*, an image capture unit 419*b*, second driven rollers 421*a*, 421*b*, 421*c*, 421*d*, an ejection tray 405, etc.

In the paper conveying apparatus 400, the side guide 404*b* is fastened. Only the side guide 404*a* are movable in the left-right direction with respect to the conveyance direction of the paper. By positioning the side guide 404*a* to match the width of the paper, it is possible to restrict the width direction of the paper.

The side guide 404*a* has a projecting part 430*a* which projects towards the downstream side of the paper feed rollers 411 when the paper tray 403 is engaged with the lower housing. The microphone 413*a* is arranged at the front end of the projecting part 430*a*. On the other hand, the side guide 404*b* does not project towards the downstream side of the paper feed rollers 411. The microphone 413*b* is arranged inside of the paper conveying apparatus 400 fastened at a position on a line extending from the side guide 404*b* in the conveyance direction of the paper.

Therefore, in the paper conveying apparatus 400 as well, the microphone 413*a* and microphone 413*b* are arranged at the two end parts of the paper in the direction which perpendicularly intersects the paper conveyance direction, so in the same way as the paper conveying apparatuses 100, 200, and 300, can effectively detect sound which is generated at the end parts of the paper regardless of the size of the paper.

As explained above in detail, in the paper conveying apparatus 400, among the two side guides, only the side guide 404*a* are movable, but the microphone 413*a* is arranged so as to move together with the side guide 404*a*, so it is possible to effectively detect sound which is generated at the end parts of a paper in a direction which perpendicularly intersects the paper conveyance direction at the time of occurrence of a jam.

According to the paper conveying apparatus, the microphones move to match the width of the paper, so it is possible to provide a paper conveying apparatus which can effectively detect a sound which is generated when a jam occurs for various types of jams.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a side guide, arranged to be movable in a direction which is perpendicular to a conveyance direction of a paper placed on a paper tray, for restricting a width direction of the paper;

a sound signal generator, provided with a sound detector at the side guide so that the sound detector moves in accordance with movement of the side guide, for generating a sound signal corresponding to a sound generated by the paper during conveyance of the paper and detected by the sound detector; and a sound jam detector for determining whether a jam has occurred based on the sound signal.

2. The paper conveying apparatus according to claim 1, further comprising a separator for separating a stack of papers for conveyance, wherein the side guide has a projecting part which projects towards a downstream side in a paper conveyance direction beyond the separator, and the sound detector is disposed on the projecting part beyond the side guide in the paper conveyance direction.

3. The paper conveying apparatus according to claim 1, further comprising a separator which separates a stack of papers for conveyance, wherein the sound detector is provided integrally with the side guide arranged at an upstream side in a paper conveyance direction of the separator.

* * * * *